United States Patent [19]

Darlington

[11] Patent Number: 4,926,832

[45] Date of Patent: May 22, 1990

[54] COMPOUND BOW WITH ADJUSTABLE CABLE LENGTH

[76] Inventor: Rex F. Darlington, 3540 Darton Rd., Hale, Mich. 48739

[21] Appl. No.: 316,773

[22] Filed: Feb. 28, 1989

[51] Int. Cl.[5] ..... F41B 5/00

[52] U.S. Cl. ..... 124/25.6; 124/90; 124/900; 124/23.1

[58] Field of Search ..... 124/23 R, 24 R, DIG. 1, 124/86, 90

[56] References Cited

U.S. PATENT DOCUMENTS

| | | | |
|---|---|---|---|
| 4,185,374 | 1/1980 | Shepley | 124/90 X |
| 4,241,715 | 12/1980 | Jennings | 124/DIG. 1 X |
| 4,333,443 | 6/1982 | Roelle | 124/90 X |
| 4,593,674 | 6/1986 | Kudlacek | 124/23 R |
| 4,686,955 | 8/1987 | Larson | 124/23 R |
| 4,748,962 | 6/1988 | Larson | 124/23 R |
| 4,838,236 | 6/1989 | Kudlacek | 124/23 R |

*Primary Examiner*—Randolph A. Reese

*Assistant Examiner*—Peter M. Cuomo

*Attorney, Agent, or Firm*—Barnes, Kisselle, Raisch, Choate, Whittemore & Hulbert

[57] ABSTRACT

A compound bow utilizes tension cables and bowstring cables acting on grooved cam pulley assemblies. The tension cables are not connected to the bowstring cables at the pulley assemblies but rather are separated at the pulleys and each separate end is formed as a loop. An attachment knob is formed integrally within the confines of the pulley and is provided with a re-entrant notch to provide a retainer attachment for the looped ends of a bowstring cable. A similar attachment can be provided for the ends of the tension cables. The concept may also be used to adjust draw length or tuning of the wheel timing as effected by the cable length by providing more than one knob spaced to allow shifting a looped end from one knob to another. The knobs with appropriate notches for the tension cables face in a direction opposite to those which receive the loop of the bowstring cable.

2 Claims, 1 Drawing Sheet

COMPOUND BOW WITH ADJUSTABLE CABLE LENGTH

FIELD OF INVENTION

Compound bows with bowstring and tension cable cams with draw length adjustment.

BACKGROUND AND FEATURES OF THE INVENTION

In the designing of long bows utilizing the so-called compound action, the Allen U.S. Pat. No. 3,486,495 (1969) was a precursor of many different pulley cam action bows. The compound bow had a main bowstring wrapping around a main pulley, eccentrically mounted, and tension cables anchored at respective bow limb ends and wrapping around a tension cable sheave adjacent the main pulley cam. One of the factors in the design of a bow is the draw length for the arrow. A person with short arms may desire a shorter draw length than a person with long arms. It can be generally stated that the longer the draw, the greater is the stored energy. Accordingly, many bow designers have directed their attention to a bow structure in which the draw length could be adjusted to suit a particular user. Also, it is an object of the invention to provide fine tuning of the cams or wheels as can be effected by bowstring length or cable length. However, the main thrust of the invention is a simple attachment molded integrally into the pulley wheels to allow attachment of the bowstring cable directly to the wheel with no mechanical tool or device needed. This system also allows elimination of the tear drop connector between a bowstring and a separate cable end.

Some examples of these designs are found in the U.S. Pat. No. 4,241,715 (1950) to Jennings, Barna U.S. Pat. No. 4,455,990 (1984), Jones U.S. Pat. No. 4,227,509 (1980) and Larson U.S. Pat. No. 4,774,927 (1988).

In many compound bow designs, the bowstring cable, sometimes called a working stretch, wraps over a main bow pulley sheave for a substantial part of the pulley circumference to allow the unwrap to occur when the arrow is drawn. In most cases the bowstring cable was then passed diametrically of the pulley cam set and led out to the sheaves of the tension cable pulley without interruption of the cable.

The invention in the present case lies in the interruption of the cable so that an end of the bowstring is directed from the circumference of the main bowstring sheave toward the interior of the sheave to terminate at an exposed area where it can be manually looped over one of a plurality of re-entrant knobs. The tension cables are then not a continuation of the main working stretch but originate at free ends which are looped over one of a plurality of re-entrant knobs. As the bowstring, that is, the working stretch, is drawn and unwraps from the main sheave, the tension cable wraps up on the tension cable sheave. Basically, the bowstring attachment in the present invention is used to capture the respective ends of a bowstring to locate it securely on the eccentric wheels on knobs on the wheels. No tools or mechanical devices are needed to attach the bowstring.

The basic concept may also be used for adjustment of bowstring length and tension cables by providing more than one anchor knob on the eccentric wheel. Thus the draw length can be adjusted by looping the end over one of the multiple reentrant knobs for shorter or longer draw length. U.S. Pat. No. 4,241,715 to Jennings illustrates one means of adjusting draw length. U.S. Pat. No. 4,440,142 to Simmons illustrates another means of adjustment in a bridle cable type of compound bow. With the present invention, the complexities of a bridle harness are eliminated.

Objects and features of the invention will be apparent in the following description and claims in which the principles of the invention are set forth together with details to enable a person skilled in the art to practice the invention, all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
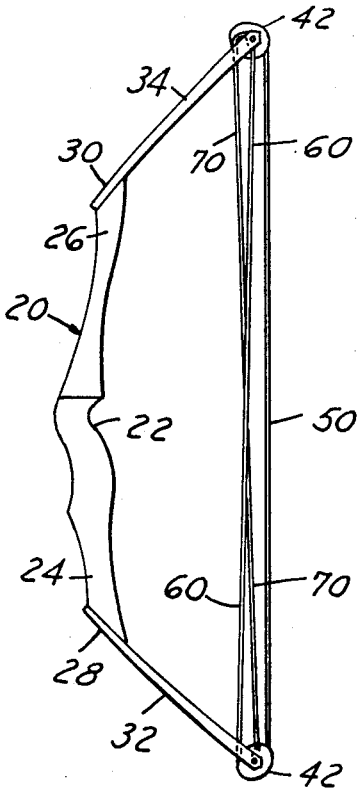
FIG. 1, a plan view of a compound bow.

With reference to the drawings, a bow handle 20 has a shaped hand grip 22 and distal ends 24, 26 to which are attached root portions 28, 30 of flexing bow limbs 32 and 34. The distal ends of the bow limbs are bifurcate with an axle pin extending transversely through each to carry eccentric bowstring pulleys and tension cable cam pulleys in a manner common to many compound bows now in use. The Allen U.S. Pat. No. 3,486,495 (1976), and the Darlington U.S. Pat. No. 4,330,910 (1982) are examples. These are incorporated by reference as to the general structure and operation of compound bows. The referenced Darlington patent shows the bowstring wrapped around a main pulley sheave and passing diametrically to an outlet at the tension cable sheave.

Figure 2:
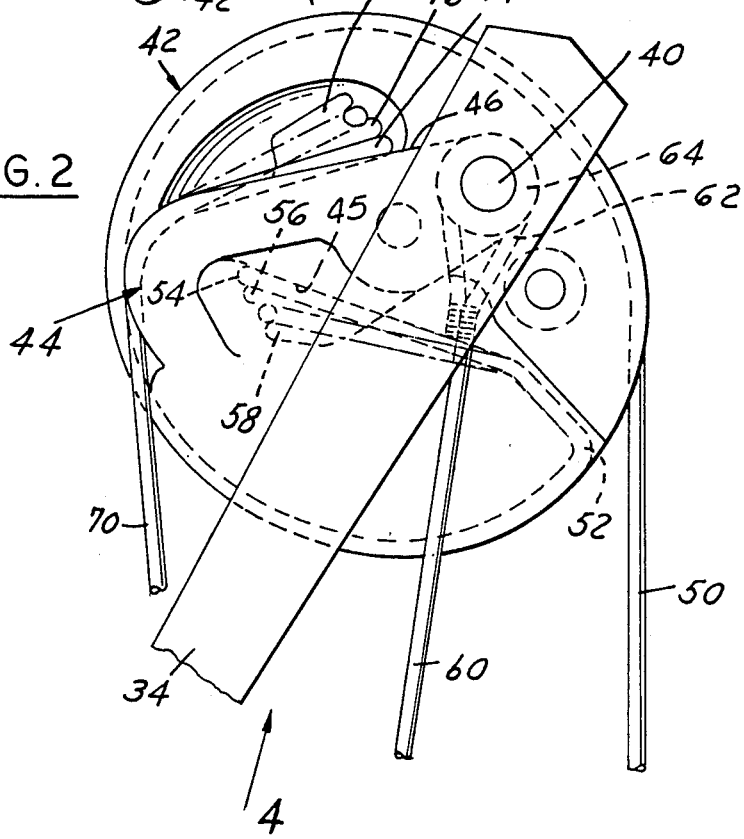
FIG. 2, an enlarged view of the cables and cam at one end of the bow.

In FIG. 2 of the drawings, an enlarged view of the top cable pulley cam assembly is illustrated on the bifurcate distal end of bow limb 34. An axle 40 rotatably mounts a bowstring pulley 42 and juxtaposed tension cable pulley 44. A bowstring cable 50 wraps in the grooved sheave of pulley 42 almost 360° and takes an inward turn at 52 across the pulley assembly.

Figure 4:
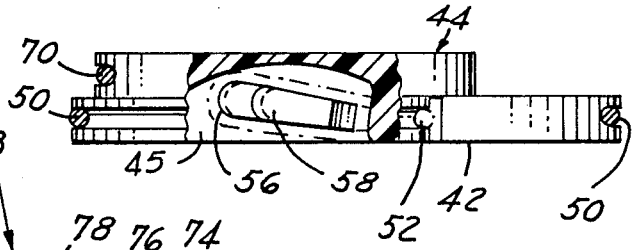
FIG. 4, a view of the cam assembly at arrow 4 of FIG. 2.

The eccentric wheels 42,44 can be molded, die cast, or machined parts and each is provided with an axially extending chordal ledge which mounts the knobs 56,58 for the bowstring and the knobs 76,78 for the tension cables. The ledge 45 has the knobs 56,58 formed integrally thereon. The ledge 46 has the knobs 76,78 formed integrally therewith. A stable loop 54 on the end of the bow string cable anchors on a hook comprising a groove within a re-entrant knob 56. A second re-entrant hook knob 58, set back from the first knob is also provided for adjustment of draw string length. A view in FIG. 4, taken on arrow line 4 of FIG. 2, illustrates these re-entrant knobs on the ledge 45.

Figure 3:
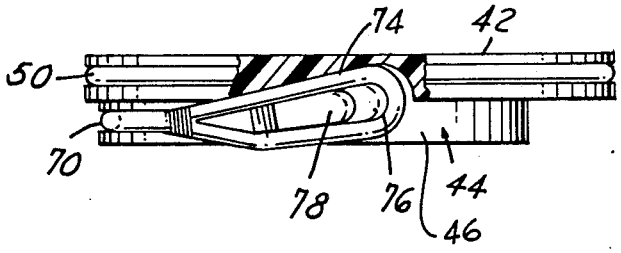
FIG. 3, a view of the cam assembly at arrow 3 of FIG. 2.

It will be appreciated that the crossed tension cables 60 and 70 (FIG. 1) are anchored respectively at opposite ends of the bow and pass over tension cable pulleys. The end of cable 60 is looped at 62 and anchored at 64 on the axle 40. The other tension cable 70 anchored at the lower end of the bow passes over the grooved sheave pulley 44 and a stable loop 74 on the end of the cable anchors on a groove in re-entrant hook knob 76 formed in the pulley assembly. A second knob 78 is formed and offset circumferentially from knob 76. As illustrated in FIG. 3, a view taken at arrow 3 of FIG. 2, the knobs 76 and 78 are seen in conjunction with the loop 74 on the ledge 46.

With loop 54 of cable 50 on knob 58 and loop 76 on knob 78 the draw length is maximum. If the respective loops are shifted to knobs 56 and 78 respectively, the draw length will be shorter.

Additional knobs to the extent of three or four at each location can vary the draw length to a much greater degree. However, the basic concept lies in the structure which permits the bowstring and the tension cables to affix securely to the pulley wheels with a simple loop and notch arrangement. The tension of the strung bow keeps the loops engaged at all times during the operation of the bow.

What is claimed:

1. In a compound archery bow including a center handle section supporting upper and lower limbs having distal ends with attached grooves, eccentric, cam wheel assemblies on each mounted on a transverse axis, and bowstring and power tension cables extending between said wheel assemblies, that improvement which comprises a bowstring having a permanent loop at each end, a bowstring wheel on each said cam wheel assembly having formed thereon an integral, axially-extending chordal projection within the peripheral confines of said bowstring wheel, a knob formed on said chordal projection having one side shaped to provide a plurality of first open grooves lying in a plane perpendicular to the plane of said wheel assembly, said bowstring being wrapped around a sheave on said bowstring wheel and turned toward the center of said wheel in a direction opposite to the open side of said grooves to overlie said chordal projection, with the looped end releasably secured in one of said grooves.

2. A compound archery bow as defined in claim 1 in which a second integral, axially extending chordal projection is formed within the peripheral confines and on the opposite side of said bowstring wheel and spaced chordally from said first projection, a knob on said second projection having one side shaped to provide a plurality of second open grooves, the open side of said second grooves extending in a direction opposite to the direction of said first open grooves, said second grooves lying in a plane perpendicular to the plane of said wheel assembly, said power tension cable having ends looped to engage one of said second open grooves on a wheel assembly, said tension cable ends each being engaged with a groove in a cam wheel assembly and extending toward the center of said assembly to overlie said second chordal projection with the looped end releasably secured on one of said second grooves.

* * * * *

UNITED STATES PATENT AND TRADEMARK OFFICE

CERTIFICATE OF CORRECTION

PATENT NO. : 4,926,832

DATED : May 22, 1990

INVENTOR(S) : Rex F. Darlington

It is certified that error appears in the above-identified patent and that said Letters Patent is hereby corrected as shown below:

Col. 3, Line 22, change "grooves" to -- grooved --.

Col. 4, Line 21, change "cable" to -- cables --.

Signed and Sealed this

Ninth Day of July, 1991

*Attest:*

HARRY F. MANBECK, JR.

*Attesting Officer*

*Commissioner of Patents and Trademarks*